US010337478B2

(12) United States Patent
Whyte et al.

(10) Patent No.: US 10,337,478 B2
(45) Date of Patent: Jul. 2, 2019

(54) FUEL INJECTOR

(71) Applicant: DELPHI TECHNOLOGIES IP LIMITED, St. Michael (BB)

(72) Inventors: Ian Whyte, London (GB); David J. Lane, London (GB); Thomas Magill, London (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/533,123

(22) PCT Filed: Oct. 29, 2015

(86) PCT No.: PCT/EP2015/075073

§ 371 (c)(1),
(2) Date: Jun. 5, 2017

(87) PCT Pub. No.: WO2016/091452

PCT Pub. Date: Jun. 16, 2016

(65) Prior Publication Data

US 2017/0335813 A1 Nov. 23, 2017

(30) Foreign Application Priority Data

Dec. 9, 2014 (GB) ..... 1421885.3

(51) Int. Cl.
*F02M 61/12* (2006.01)
*F02M 47/02* (2006.01)

(52) U.S. Cl.
CPC ..... *F02M 61/12* (2013.01); *F02M 47/027* (2013.01); *F02M 2200/28* (2013.01); *F02M 2200/304* (2013.01)

(58) Field of Classification Search
CPC .. F02M 61/12; F02M 2200/28; F02M 47/027; F02M 2200/304
See application file for complete search history.

(56) References Cited

U.S. PATENT DOCUMENTS 4,544,096 A 10/1985 Burnett
4,591,100 A * 5/1986 Gaskell ..... F02M 61/166 239/533.3
5,860,597 A 1/1999 Tarr
8,069,840 B2 * 12/2011 Magel ..... F02M 47/027 123/445
8,864,054 B2 * 10/2014 Burger ..... F02M 47/027 239/533.11
9,234,487 B2 1/2016 Cooke
(Continued)

FOREIGN PATENT DOCUMENTS

DE 202 02 338 U1 5/2002
DE 10 2009 001 704 A1 9/2010
(Continued)

*Primary Examiner* — Alexander M Valvis
(74) *Attorney, Agent, or Firm* — Joshua M. Haines

(57) ABSTRACT

A fuel injector includes a collar, which may be formed of a porous, sintered material, the collar being located around the needle and allowing a restricted fluid pathway, such as orifices through the collar, between first and second volumes of fuel, the collar being located in a section of the nozzle body which has a greater cross-sectional area than the rest of the bore.

10 Claims, 6 Drawing Sheets

(56) References Cited

U.S. PATENT DOCUMENTS

| | | | | |
|---|---|---|---|---|
| 2006/0071100 | A1* | 4/2006 | Cooke | F02M 45/086<br>239/533.9 |
| 2006/0186227 | A1 | 8/2006 | Augustin | |
| 2011/0048379 | A1 | 3/2011 | Sommars et al. | |

FOREIGN PATENT DOCUMENTS

| | | | |
|---|---|---|---|
| DE | 10 2009 045 348 | A1 | 4/2011 |
| EP | 0 971 118 | A2 | 1/2000 |
| EP | 1 990 532 | A1 | 11/2008 |
| GB | 2107781 | B | 12/1984 |
| WO | 2012/163759 | A1 | 12/2012 |

* cited by examiner

FUEL INJECTOR

CROSS REFERENCE TO RELATED APPLICATIONS

This application is a national stage application under 35 USC 371 of PCT Application No. PCT/EP2015/075073 having an international filing date of Oct. 29, 2015, which is designated in the United States and which claimed the benefit of GB Patent Application No. 1421885.3 filed on Dec. 9, 2014, the entire disclosures of each are hereby incorporated by reference in their entirety.

TECHNICAL FIELD

The present invention relates to a fuel injector such as a diesel fuel injector, and more specifically to a damping mechanism for controlling opening and closing movements of a valve needle in a fuel injector.

BACKGROUND OF THE INVENTION

Known fuel injectors, wherein fuel is supplied from an accumulator volume such as a diesel common rail, comprise a valve needle located for reciprocating movement within a bore of the fuel injector, under the control of a control valve, thereby to effect injection of fuel from one or more spray holes located in a tip of the nozzle body, into a combustion chamber.

Movement of the valve needle between open and closed positions is controlled by forces acting upon it resulting from a pressure difference between high pressure fuel in a barrel surrounding part of the valve needle, and fuel pressure in a control chamber surrounding a top end of the valve needle. The pressure in the control chamber volume, and therefore the forces acting upon the valve needle, are controlled by the control valve, and modulated by an inlet valve orifice (INO) and a restricted drain orifice (RDO), thereby influencing the motion of the valve needle, i.e. the rate of lift, damping, opening and closing velocities, and impact forces of the valve needle against upper and lower valve seats. However, the INO and the RDO are functions of fuel pressure within the accumulator volume, and therefore the degree of control they have on motion of the valve needle is restricted.

A known method of providing improved control over the movement of the valve needle is disclosed in European patent application no. EP0971118A (Isuzu Motors Limited), one embodiment of which comprises collar fitted to the valve needle, whereby the collar allows a limited, throttled fuel flow via a through hole located in the collar. However, as the collar is located in the barrel of the nozzle body, the effectiveness of the collar on improving needle motion control is sensitive to eccentricity in relation to the barrel bore. In particular, the location of the collar within the bore increases eccentricity of the collar due to a stack up of additional tolerances.

SUMMARY OF THE INVENTION

It is an object of the present invention to provide an improved needle motion control means for a fuel injector, which at least mitigates the above mentioned problems.

Accordingly the present invention provides, in a first aspect, a fuel injector with a piston guide section; a nozzle body; a barrel section located between the piston guide section and the nozzle body; a valve needle, movable along a longitudinal axis of the fuel injector, within a bore comprising a piston guide bore section, a bore provided in the barrel section, and a bore provided in the nozzle body, and wherein the valve needle comprises a first end region within the nozzle body, and a second end region within the piston guide section; a nozzle control valve, for controlling fuel pressure within a control chamber surrounding the second end region of the valve needle, and thereby controlling the magnitude of a force applied to a pressure surface provided at the second end region of the valve needle, by fuel pressure within the control chamber; wherein the valve needle is movable, under the control of the nozzle control valve, between a fully closed position, in which a first surface provided at the first end region of the valve needle is in contact with a first seating region, provided in the nozzle body, and wherein ejection of fuel out of the nozzle body through at least one spray hole is prevented, and a fully open position, wherein a second surface provided at the second end region of the valve needle is in contact with a second seating region provided in the piston guide section, and wherein ejection of fuel out of the nozzle body through the at least one spray hole is enabled; and a needle motion control means comprising a collar, located in a collar locating section of the bore provided in the nozzle body, the collar allowing a restricted fluid pathway between a first volume of fuel, and a second volume of fuel, located further away from the piston guide section than the first volume of fuel; wherein the collar locating section comprises a section of the bore provided in the nozzle body, and has a cross-sectional area which is greater than that of a remainder of the bore provided in the nozzle body.

The collar may be a cross-sectional area which is greater than that of the bore provided in the barrel section.

Preferably, a first face of the collar, adjacent the first volume of fuel, and a second face of the collar, each have a surface area which is greater than a surface area of the pressure surface.

Preferably, a clearance between the collar and the collar locating section is of a sufficiently low value so as to prevent fuel from flowing through the clearance between the first volume of fuel and the second volume of fuel.

The restricted fluid pathway may comprise at least one orifice provided through the collar.

The collar may be provided with two orifices located at opposing positions on the collar either side of the valve needle, at equal distances from the valve needle.

The collar may comprise a porous material. The collar may be at least partially formed of a sintered material.

The collar may be formed integrally with a spring seat against which an end of a spring, which biases the valve needle towards a closed position, abuts.

The spring may abut a contact surface of the spring seat, wherein the contact surface is axially separated from the collar.

In a further aspect, the present invention comprises a method of assembling a needle motion control means as described above, the method including push fitting the collar onto the valve needle in an interference fit.

In a further aspect, the present invention comprises a fuel injector including a needle motion control means as described above.

BRIEF DESCRIPTION OF THE DRAWINGS

The present invention is now described by way of example with reference to the accompanying figures, in which.

and

Figure 8:
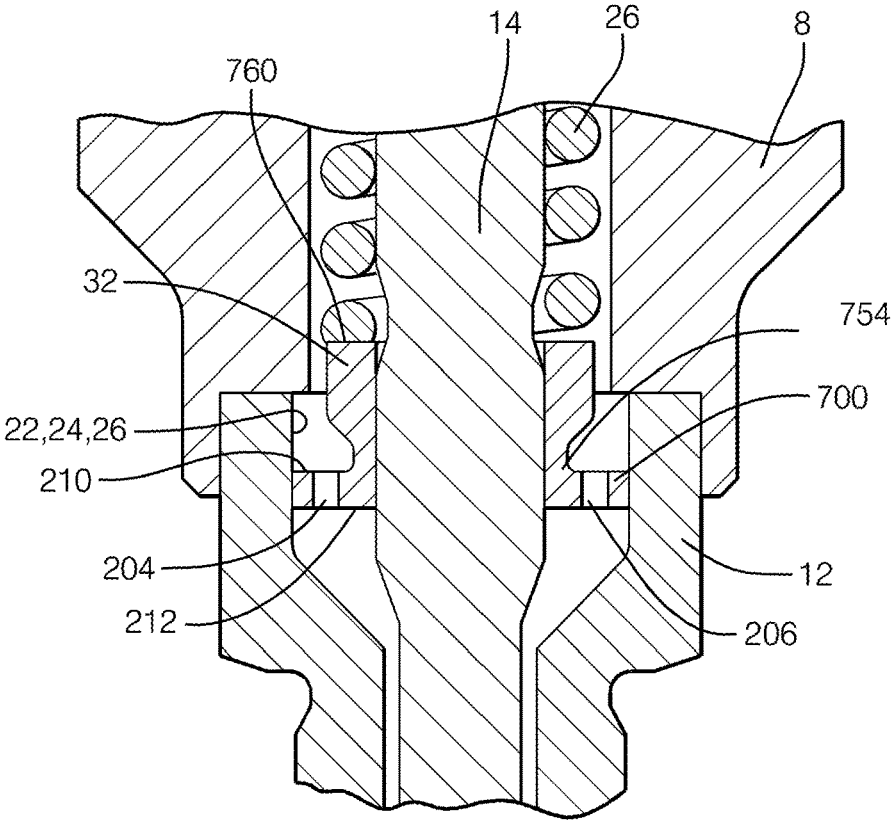
Figure 7:
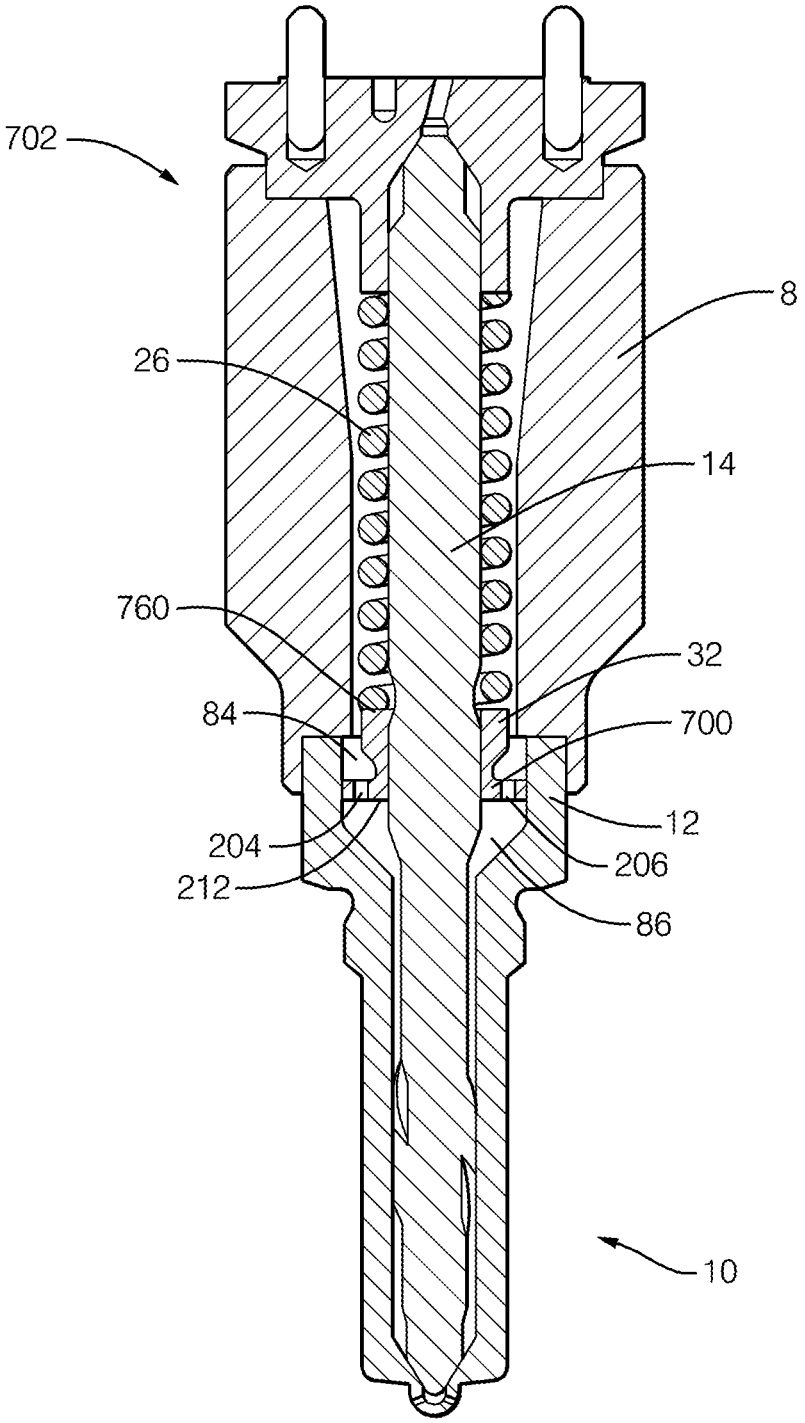
FIG. 7 is a cross-sectional view a fuel injector incorporating a further alternative embodiment of NMC collar in accordance with the present invention.

FIG. 8 is a partial cross-section view of the fuel injector of FIG. 7.

DESCRIPTION OF THE PREFERRED EMBODIMENTS

In the description of the present below, relative terms such as upper, lower, above, below, top and bottom, are used in relation to the Figures only, and are not intended to be limiting.

Figure 1:
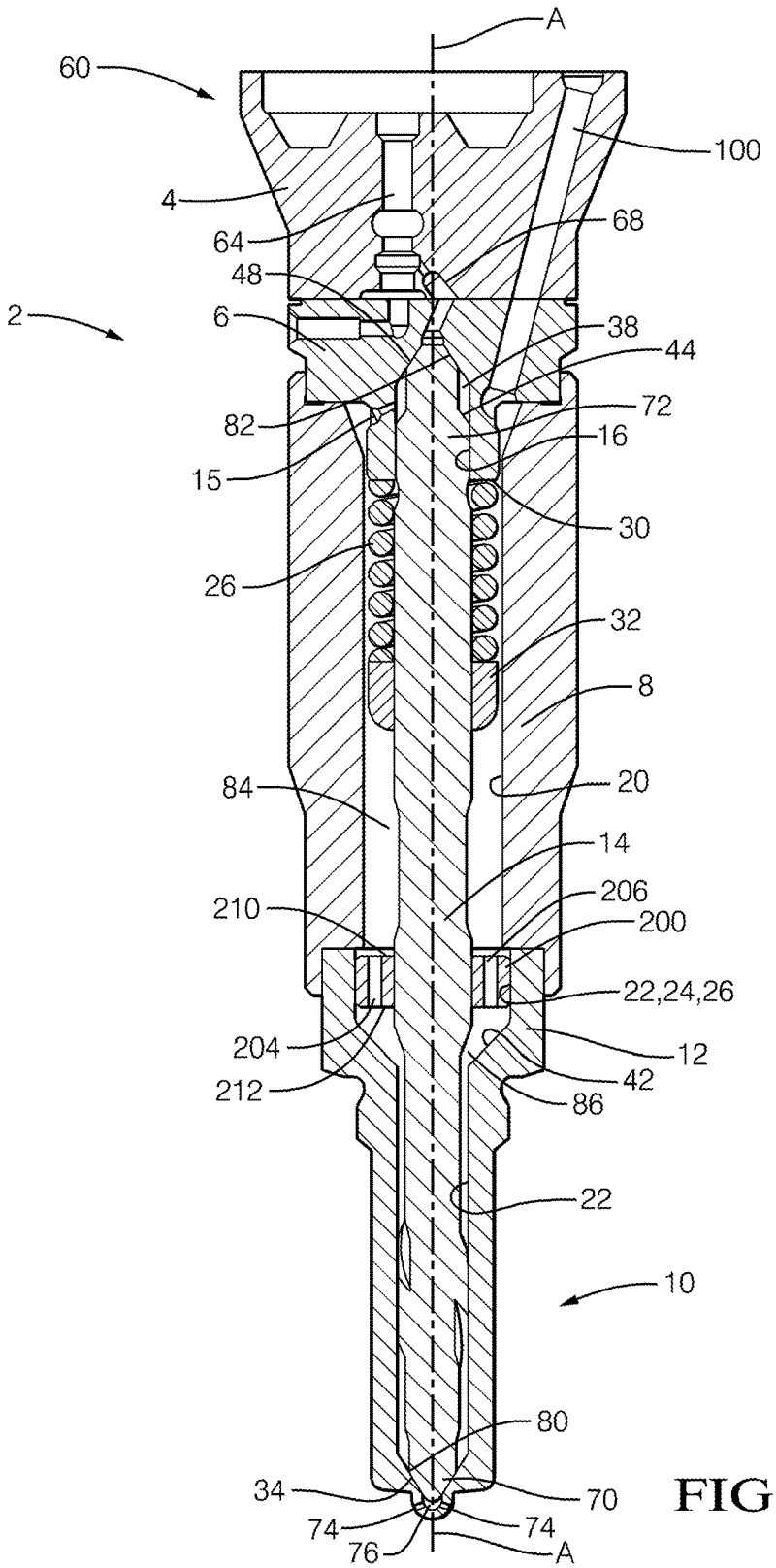
FIG. 1 is a cross sectional view of a fuel injector comprising a NMC collar in accordance with the present invention.
Figure 2:
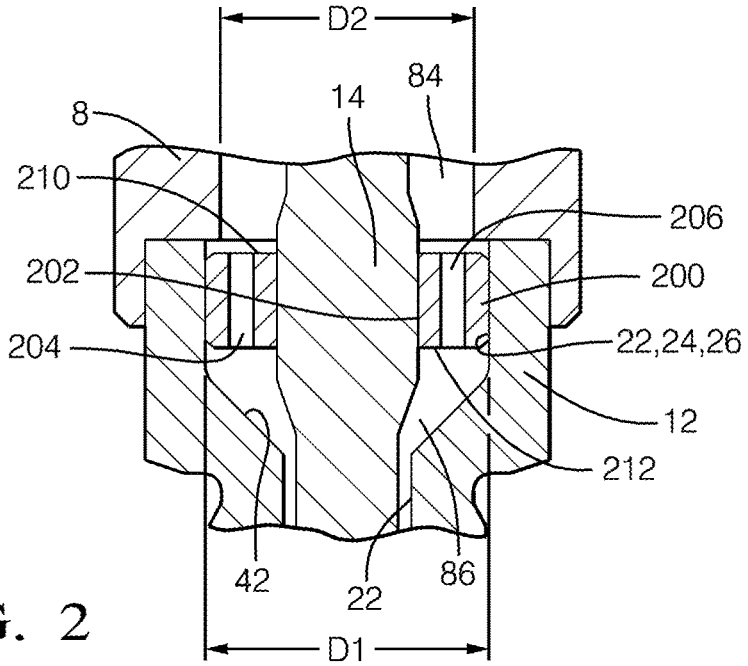
FIGS. 2 and 3 are detailed cross-sectional the indicated areas of the fuel injector of FIG. 1.
Figure 3:
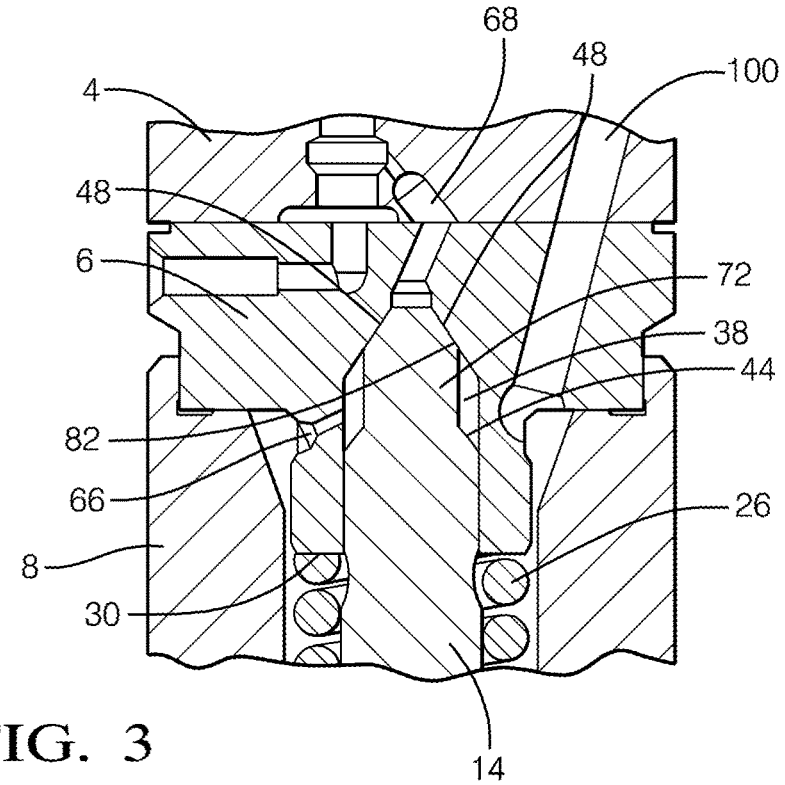

Referring to FIGS. 1 to 3, a first embodiment of the present invention comprises a needle motion control element, comprising a needle motion control collar 200 (NMC collar 200), fitted to a fuel injector 2. From top to bottom, the fuel injector 2 comprises a first injector body portion 4, a piston guide section 6, a barrel section 8, and a nozzle body 10. The nozzle body 10 comprises a nozzle body head 12, proximate to the barrel section 8.

The fuel injector 2 further comprises a valve needle 14, comprising an elongate member having a first, lower end region 70, extending within the nozzle body 10, and a second, upper end region 72, extending into the piston guide section 6. The valve needle 14 is arranged for reciprocating movement along a longitudinal axis A of the injector, within a bore of the injector, the bore comprising a guide bore 16 provided in the piston guide section 6, a bore 20 provided in the barrel section 8, and a bore 22 provided in the nozzle body 10. The bore 22 provided in the nozzle body 10 comprises an enlarged section 24 in the nozzle body head 12, i.e. the enlarged section 24 has a greater cross-sectional area than the remainder of the bore 22 of the nozzle body 10.

The barrel section 8 is supplied with high pressure fuel from an accumulator volume (not shown in the figures), such as a common rail, via a fuel inlet 100.

A biasing spring 26 is provided between a first spring seat, provided by a lower face 30 of the piston guide section 6, and a second spring seat 32 provided on the valve needle 14, within the barrel section 8. The spring 26 biases the valve needle 14 towards a closed position, in which a first frustoconical surface 34 provided at the first, lower end region 70 of the valve needle 14 is engaged with a first, lower seating region 80, provided in the nozzle body 10.

Within the piston guide section 6 and towards an upper end of the guide bore 16, a control chamber 38, around the second, upper end region 72 of the valve needle 14. A nozzle control valve (NCV) 60, comprising a control valve member movable within a bore 64, is provided in the first injector body portion 4. The NCV 60 is controlled by an actuator (not shown) located above the NCV 60. The actuator is operable to control the position of the control valve member within the bore 64, thereby controlling fuel pressure within the control chamber 38, and thereby controlling movement of the valve needle 14 between the closed position and an open position, as explained in greater detail below. Pressure of fuel within the control chamber 38 is modulated by an inlet orifice (INO) 66 and a restricted drain orifice (RDO) 68 provided in the piston guide section 6.

When the control valve member is in a first position, the pressure of fuel in the control chamber 38 is relatively high, and the valve needle 14 remains in a closed position, as illustrated in the figures, under the biasing of the spring 26, i.e. wherein the first frustoconical surface 34 at the first, lower end region 70 of the valve needle 14 is urged into engagement with the first, lower seating region 80, provided in the nozzle body 10. In the closed position, the first frustoconical surface 34 at the first, lower end 70 of the valve needle 14 seals one or more spray holes 74 provided in the nozzle body 10, thereby preventing injection of fuel through the spray holes 74 to a combustion chamber (not shown in the figures).

When the control valve member is moved from a first position to a second position, in response to energisation of the actuator, fuel pressure within the control chamber 38 drops to a relatively low level. The downward force acting on the first frustoconical surface 34 at the second, upper end region 72 of the valve needle 14 as a result of fuel pressure in the control chamber 38 therefore also drops. An upward force applied to the valve needle 14 by high pressure fuel within the barrel section 8 therefore overcomes a downward force applied to the valve needle 14 by the biasing of the spring 26. The valve needle 14 therefore begins to move upwardly, in an opening motion, towards the open position, i.e. the first frustoconical surface 34 at the first, lower end region 70 of the valve needle 14 disengages with the first, lower seating region 80, and a second frustoconical surface 48 at the second, upper end region 72 of the valve needle 14 is urged towards a second, upper seating region 82, provided within the piston guide section 6. Fuel injection is thereby enabled, i.e. ejection of fuel from a nozzle sac 76 provided in the nozzle body 10, through the spray holes 74, to the combustion chamber is enabled. Movement of the valve needle 14 continues until the second frustoconical surface 48 at the second, upper end region 72 of the valve needle 14 impacts against the second, upper seating region 82, i.e. until the valve needle 14 is in a fully open position.

When the actuator is de-energised, fuel pressure within the control chamber 38 begins to increase, applying an increasing downwards force to the valve 14 via a pressure surface 44 located at the second, upper end region 72 of the valve needle 14, causing the valve needle 14 to move downwards, in a closing motion. Movement of the valve needle 14 continues until the first frustoconical surface 48 at the first, lower end region 70 of the valve needle 14 contacts the first, lower seating region 80, i.e. until the valve needle 14 member has returned to the fully closed position.

The NMC collar 200 is a separate component to the valve needle 14, and is located around the valve needle 14 in the enlarged section 24 of the bore 22 provided within the nozzle body head 12, i.e. the enlarged bore section 24 acts as a collar locating bore section.

The enlarged section 24 of the bore 22 is defined by an annular wall 46, of sufficient axial depth to allow movement of the needle valve 14 and the collar 200 between the open and closed positions. Below the enlarged section 24, the bore 22 of the nozzle body 10 comprises a frustoconical section 42 which, gradually decreases in cross-sectional area moving away from the enlarged section 24.

The external diameter D1 of the NMC collar 200 is larger than the diameter D2 of the bore 20 of the barrel section 8.

The NMC collar 200 is annular, with a central aperture 202 to allow assembly of the collar 200 onto the valve needle 14. During assembly, the NMC collar 200 is pushed onto the valve needle 14, and is bonded to the valve needle 14 by an interference fit. The interference fit between the NMC collar 200 and the valve needle 14 provides a retaining force between the two components sufficient to prevent any movement of the NMC collar 200 along the valve needle 14 during operation of the injector 2.

Two drilled orifices 204, 206 are provided axially through the NMC collar 200, located at opposing positions on the collar 200 either side of the valve needle 14, and at equal distances from the valve needle 14, thereby ensuring an even pressure distribution across the collar 200. Each orifice 204, 206 provides a fluid pathway from a first, top face 210 of the collar 200 to a second, bottom face 212 of the collar 200.

In an alternative embodiment, a single drilled orifice 204/206 could be provided axially through the NMC collar 200.

Each of the first, top face 210 and the second, bottom face 212 of the NMC collar 200, comprising radial surfaces in relation to the longitudinal axis A of the injector, defines a surface area; each surface area is significantly greater than the area of the pressure surface 44 at the second, upper end region 72 of the valve needle 14 on which forces within the control chamber 38 act.

A first, upper volume of fuel 84 is present above the NMC collar 200, and a second, lower volume of fuel 86 is present below the NMC collar 200, partially comprising fuel within the frustoconical section 42 of the nozzle body bore 22. Accordingly, a varying force is applied to the first, top face 210 of the NMC collar 200, dependent upon fuel pressure within the first volume of fuel 84, and a varying force is applied to the second, bottom face 212 of the NMC collar 200 dependent upon fuel pressure within the second volume of fuel 86.

The NMC collar 200 provides a restricted fluid pathway between the first volume of fuel 84 and the second volume of fuel 86, by only allowing a fluid pathway between the two fuel volumes 84, 86 through the two drilled orifices 204, 206. Clearance between the NMC collar 200 and the collar locating bore 24 is minimised, to prevent flow of fuel through the clearance, thereby maximising fuel flow through the drilled orifices 204, 206.

During operation of the injector, the collar 200 creates a pressure difference between the first, upper volume of fuel 84 and the second, lower volume of fuel 86, which results in a downward force acting on the valve needle 14, i.e. urging the valve needle 14 toward the closed position.

The opening movement of the needle valve 14 is thereby damped by the pressure difference created between the first and second volumes of fuel 84, 86 by the NMC collar.

Furthermore, during the closing movement of the valve needle 14, downwards force applied to the needle valve 14 by the NMC collar 200 is additionally to the downwards force provided by fuel pressure within the control chamber 38, thereby increasing the overall downwards force applied to the needle valve 14.

The difference in fuel pressure between the first, upper volume of fuel 84 and the second, lower volume of fuel 86 is determined by the cross-sectional areas of the drilled orifices 204, 206 in the NMC collar 200. Orifices having a relatively smaller cross-sectional area create a larger pressure difference than orifices having a relatively larger cross-sectional area. Accordingly, a required magnitude of damping force can be achieved by providing orifices of a selected cross-sectional area.

Figure 4:
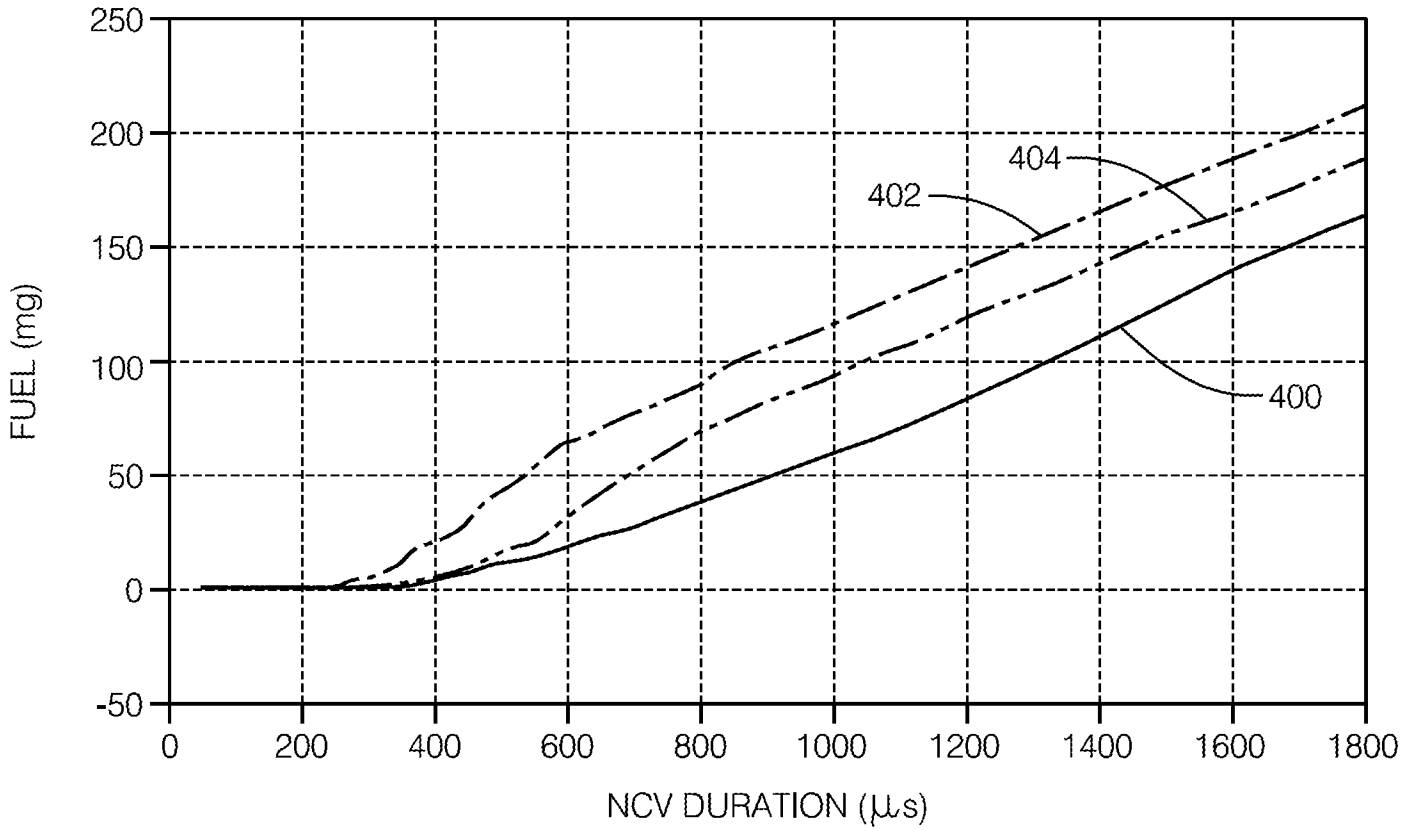
FIG. 4 is a graphical comparison of fuelling at the start of an injection event, for two injectors without an NMC collar and one injector with an NMC collar in accordance with the present invention.

FIG. 4 is a graphical representation of fuelling at the start of an injection event, i.e. representing fuel volume (mg) against NCV duration (μs), at a rail pressure of 1500 bar. The graph illustrates results for one fuel injector provided with an NMC collar of the present invention (represented by line 400), for example with orifices 204, 206 each having a diameter of 1 mm, and two fuel injectors not provided with an NMC collar (represented by lines 402 and 404). As illustrated by the graph of FIG. 4, due to the damping provided by the NMC collar, the gain curve 400 for the fuel injector provided with the collar is smoother than the gain curves 402, 404 for the injectors which are not provided with an NMC collar, each of which display a 'knee' feature representing a disruption in the gain curve.

Figure 5:
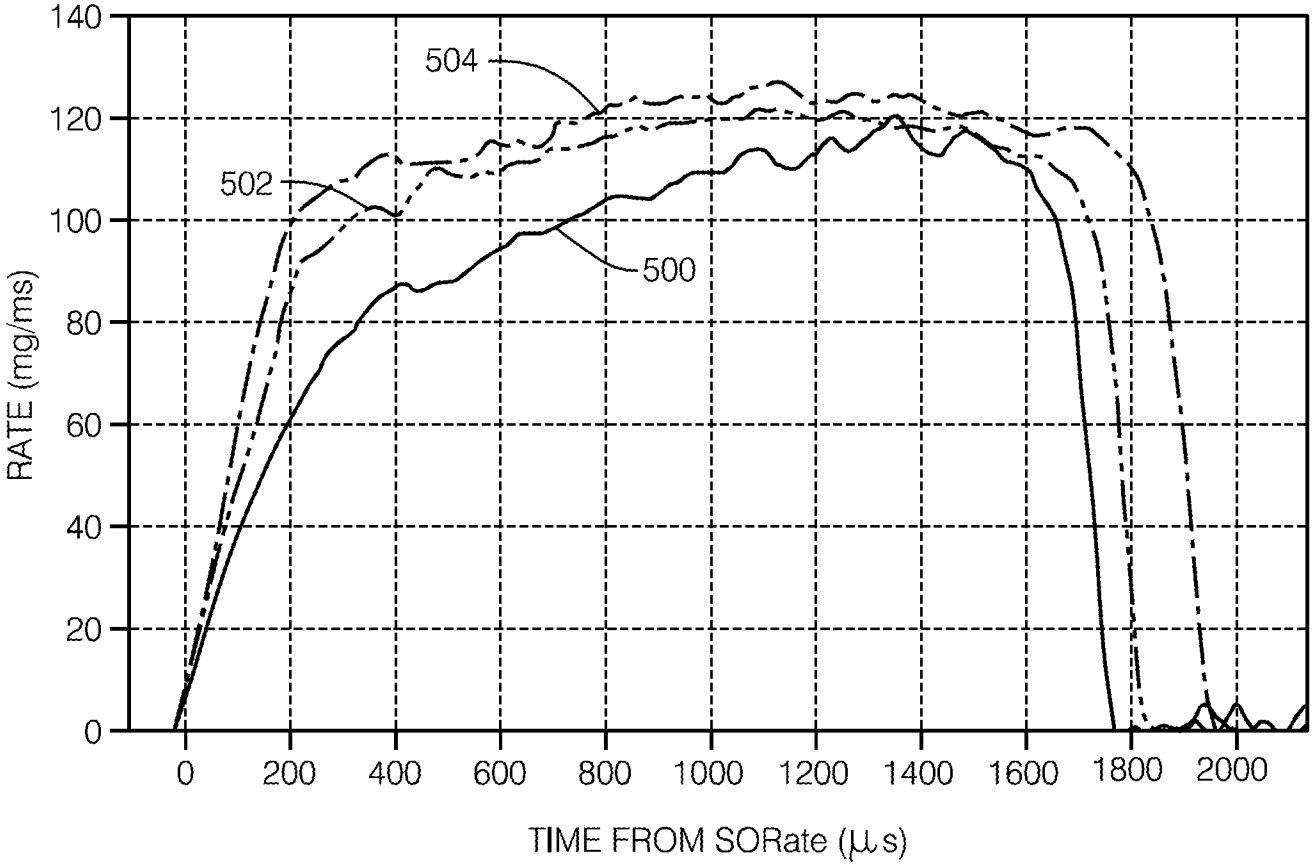
FIG. 5 is a graphical representation of fuelling rate throughout an injection event, for two prior art injectors and an injector comprising an NMC collar 200 in accordance with the present invention.

FIG. 5 is a graphical representation of fuelling throughout an injection event, i.e. fuel flow rate (mg/ms) against time from SORate (i.e. Start of Rate) (μs), i.e. the point at which fuel starts to flow through the spray holes 74, for an injector provided with an NMC collar (represented by line 500), an undamped fuel injector not provided with an NMC collar (represented by line 502), and a damped fuel injector not provided with an NMC collar (represented by line 504). As illustrated, the injector provided with the NMC collar displays an increased SO rate damping (i.e. the gradient at the start of the rate trace), and a decreased T4 time value (i.e. the time taken from the end of electrical current being applied to the actuator until the end of flow through the flow holes 74). i.e. the graph demonstrates that the closing movement time of the needle valve 14 of the injector provided with the NMC collar is shorter than both the damped and undamped injectors without an NMC collar.

The NMC collar 200 acts as a damper when the valve needle 14 is in the process of opening, thereby smoothing gain curve linearity, by reducing the force impact of the second frustoconical surface 48 at the second, upper end region 72 of the valve needle 14 on the second, upper seating region 82. The smooth, controlled movement of the valve needle 14 reduces any bounce of the valve needle 14 off the upper seating region 82 after impact.

The velocity at which the valve needle 14 is moving is highest just before the second frustoconical surface 48 at the upper end region 72 of the valve needle 14 contacts the upper seating region 82. The velocity of the valve needle 14 is increased at higher fuel flow volumes which, in prior art embodiments, can lead to problems with the resultant gain curve, due to the significant effect of impact of the valve needle 14 against the upper seating region 82. The NMC collar 200 provides a damping force which is higher at high fuel flows, and hence the damping force, and control of the motion of the valve needle 14, are functions of fuel flow. This is advantageous over prior art embodiments, in which motion of the valve needle is modulated by an INO and an RDO, which are functions of rail pressure.

Needle motion control at the end of an injection event is also improved over prior art embodiments, due to an additional downward force being applied to the valve needle 14, thereby allowing a more rapid closing velocity, and reducing the bounce of the valve needle 14 after impact of the first frustoconical surface 48 at the lower end region 70 of the valve needle 14 against the second, lower seating region 80. The amount of damping can be easily controlled by adjusting the cross-sectional areas of the orifices 204, 206, and the significantly larger surface area the NMC collar 200 has over the surface at the top portion of the of the valve needle 14 allows for much greater forces to be generated on the valve needle 14 than the designs in prior art embodiments.

The NMC collar 200 of the first embodiment could be formed of a steel, for example BS EN 10083-1 51 CrV4.

Figure 6:
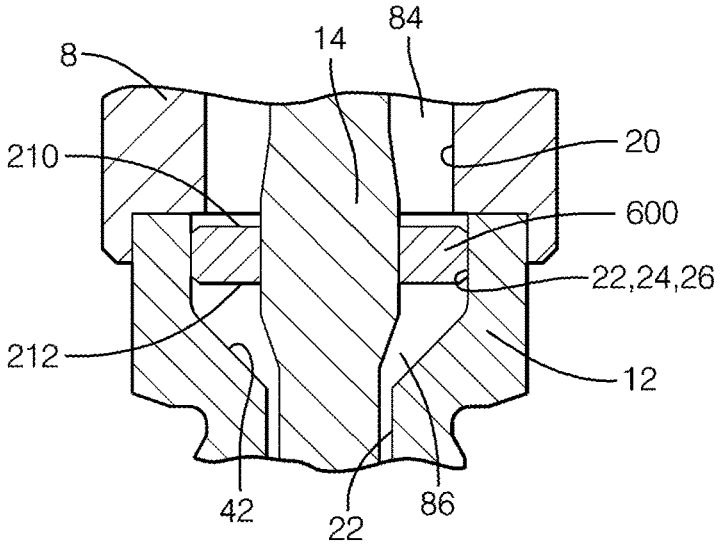
FIG. 6 is a partial cross-sectional view of a fuel injector incorporating an alternative embodiment of NMC collar in accordance with the present invention.

In an alternative embodiment of the present invention, as illustrated in FIG. 6, the NMC collar 600 is formed, at least partially, of a porous material such as a sintered flange. The drilled orifices 204, 206 of the first embodiment are not present in this alternative embodiment; instead, the porosity of the material replicates the effect of the drilled orifices, in creating a pressure drop between the first volume of fuel and the second volume of fuel by providing a restricted fluid pathway across the collar 600, thereby improving needle motion control.

In addition to the benefit of gain curve linearization, the collar 600 of the second embodiment also acts as a pulsation damper, i.e. the collar 600 acts to suppress multiple pressure waves which occur during an injection event, which would otherwise cause fluctuations in fuelling.

A further alternative embodiment of the present invention is illustrated in FIGS. 7 and 8. An injector 702 is similar to the injector 2 as described above, however the alternative NMC collar 700, is joined integrally to the second, lower spring seat 32.

The NMC collar 700 is similar in form to the NMC collars 200, 600 of the first two embodiments; i.e. it is located within a collar locating section 24 of the nozzle body head 12, and comprises two orifices 204, 206 extending axially through the collar 700 which provide a restricted fluid pathway between a first volume of fuel 84 and a second volume of fuel 86.

The spring seat 32 is separated from the NMC collar 700 by a neck provided by an annular cut-out 754 (see FIG. 8); the cut-out 754 ensures a flow path from the first volume of fuel 84 to the orifices 204, 206 is maintained.

The spring seat section 32 comprises a top surface 760, against which the lower end of the spring 26 abuts.

In the alternative NMC collar 700, the surface 760 against which the spring 26 abuts is axially separated from the restricted flow paths provided by the orifices 204, 206. The 'two tier' combined NMC collar/spring seat allows for the use of a tight annular clearance between the collar 700 and the collar locating bore 24 thereby to minimise flow whilst maintaining an enhanced flow control via the orifices 204, 206.

The alternative embodiment of FIG. 7 could be combined with other features of the present invention, i.e. the collar 700 could be at least partially formed of a sintered material, and could be provided with a single drilled orifice.

In the present invention, locating the NMC collar 200, 600, 700 in the nozzle body head 12 maintains maximum concentricity between the collar 200, 600, 700 and the collar locating bore 24 of the nozzle body head 12. Furthermore, the volume of fuel 84 above the collar 200, 600, 700 is maximised, and the volume of fuel 86 below the collar 200, 600, 700 is minimised.

By locating the collar 200, 600, 700 within an enlarged section 24 of the nozzle body bore, it is also possible to provide a larger collar 200, 600, 700 i.e. having a larger surface area, therefore increasing the force applied to the collar 200, 600, 700 by fuel pressure within the first volume of fuel 84.

In the present invention, the NMC collar 200, 600, 700 acts to improve needle motion control as explained above. The NMC collar 200, 600, 700 ensures an improved injector performance compared to prior art embodiments, by ensuring a linear response of fuelling with respect to duration of electrical current applied to the actuator, with the greatest percentage change usually noticed at low fuelling quantities. The NMC collar 200, 600, 700 is particularly advantageous in the introduction of multiple injection strategies to meet Euro V and Euro VI Emissions Standards, which require consistency of small injection amounts for pilot or post injections to retain effectiveness.

The NMC collar 200, 600, 700 also results in gains in terms of combustion noise and Brake Specific Fuel Consumption, which are enabled by correct optimisation of actuator and nozzle design.

REFERENCES

NMC collar 200, 600, 700
fuel injector 2, 702
first injector body portion 4
piston guide section 6
barrel section 8
nozzle body 10
nozzle body head 12
valve needle 14
guide bore 16
barrel bore 20
nozzle body bore 22
nozzle body bore enlarged section 24
biasing spring 26
first spring seat/piston guide section lower face 30
second spring seat 32
first frustoconical surface 34
control chamber 38
nozzle control valve 60
control valve bore 64
inlet orifice 66
restricted drain orifice 68
needle first, lower end region 70
needle second, upper end region 72
spray holes 74
nozzle sac 76
first, lower seating region 80
first, upper volume of fuel 84
second, lower volume of fuel 86
fuel inlet 100
collar central aperture 202
collar drilled orifices 204, 206
collar first, top face 210
collar second, bottom face 212
NMC collar gain curve 400
other injector gain curves 402, 404
FIG. 5 NMC collar line 500
other injector lines 502, 504
annular cut-out 754
spring seat section top surface 760
longitudinal axis A

The invention claimed is:

1. A fuel injector comprising:

a piston guide section;

a nozzle body;

a barrel section located between the piston guide section and the nozzle body;

a valve needle, movable along a longitudinal axis of the fuel injector, within a bore comprising a piston guide bore section, a bore provided in the barrel section, and a bore provided in the nozzle body, and wherein the valve needle comprises a first end region within the nozzle body, and a second end region within the piston guide section;

a nozzle control valve, for controlling fuel pressure within a control chamber surrounding the second end region of the valve needle, and thereby controlling the magnitude of a force applied to a pressure surface provided at the second end region of the valve needle, by fuel pressure within the control chamber; wherein the valve needle is movable, under the control of the nozzle control valve, between a fully closed position, in which a first surface provided at the first end region of the valve needle is in contact with a first seating region, provided in the nozzle body, and wherein ejection of fuel out of the nozzle body through at least one spray hole is prevented, and a fully open position, wherein a second surface provided at the second end region of the valve needle is in contact with a second seating region provided in the piston guide section, and wherein ejection of fuel out of the nozzle body through the at least one spray hole is enabled; and a needle motion control means comprising a collar, located in a collar locating section of the bore provided in the nozzle body, the collar allowing a restricted fluid pathway between a first volume of fuel, and a second volume of fuel, located further away from the piston guide section than the first volume of fuel;

wherein the collar locating section comprises a section of the bore provided in the nozzle body, and has a cross-sectional area which is greater than that of a remainder of the bore provided in the nozzle body; and wherein the collar has a cross sectional area which is greater than that of the bore provided in the barrel section.

2. The fuel injector as claimed in claim 1, wherein a first face of the collar, adjacent the first volume of fuel, and a second face of the collar, each have a surface area which is greater than a surface area of the pressure surface.

3. The fuel injector as claimed in claim 1, wherein a clearance between the collar and the collar locating section prevents fuel from flowing through the clearance between the first volume of fuel and the second volume of fuel.

4. The fuel injector as claimed in claim 1, wherein the restricted fluid pathway comprises at least one orifice, provided through the collar.

5. The fuel injector as claimed in claim 4 wherein the collar is provided with two orifices located at opposing positions on the collar either side of the valve needle, at equal distances from the valve needle.

6. The fuel injector as claimed in claim 1, wherein the collar comprises a porous material.

7. The fuel injector as claimed in claim 6, wherein the collar is at least partially formed of a sintered material.

8. The fuel injector as claimed in claim 1, wherein the collar is formed integrally with a spring seat against which an end of a spring, which biases the valve needle towards a closed position, abuts.

9. The fuel injector as claimed in claim 8, wherein the spring abuts a contact surface of the spring seat, and wherein the contact surface is axially separated from the collar.

10. A method of a assembling the fuel injector as claimed in claim 1, the method comprising push fitting the collar onto the valve needle in an interference fit.

* * * * *